United States Patent [19]

Stluka et al.

[11] Patent Number: 4,762,345

[45] Date of Patent: Aug. 9, 1988

[54] AIR OPERATED POSITIVE LOCK FOR REFUSE TRAILER AND THE LIKE

[75] Inventors: Eugene F. Stluka, Haverford; William J. Huber, Audubon, both of Pa.

[73] Assignee: Florig Equipment Company, Inc., Conshohocken, Pa.

[21] Appl. No.: 32,869

[22] Filed: Mar. 31, 1987

[51] Int. Cl.[4] ..... E05C 19/12

[52] U.S. Cl. ..... 292/26; 292/48; 292/201

[58] Field of Search ..... 292/26, 48, 217, 196, 292/DIG. 32, DIG. 49, 201

[56] References Cited

U.S. PATENT DOCUMENTS

| | | | |
|---|---|---|---|
| 966,926 | 8/1910 | Knapp | 292/DIG. 49 X |
| 2,815,085 | 12/1957 | Whipple | 292/196 X |
| 2,949,327 | 8/1960 | Totaro et al. | 292/26 |
| 3,813,119 | 5/1974 | Panici | 292/201 X |
| 3,880,072 | 4/1975 | Ord | 292/304 X |
| 3,888,528 | 6/1975 | Jericijo | 292/DIG. 49 X |
| 3,917,328 | 11/1975 | De Filippi | 292/DIG. 49 X |

FOREIGN PATENT DOCUMENTS

| | | | |
|---|---|---|---|
| 524460 | 12/1953 | Belgium | 292/201 |
| 808068 | 3/1969 | Canada | 292/201 |
| 183597 | 11/1966 | U.S.S.R. | 292/26 |

*Primary Examiner*—Gary L. Smith
*Assistant Examiner*—Curtis B. Brueske
*Attorney, Agent, or Firm*—Volpe and Koenig

[57] ABSTRACT

An apparatus for securing a rotatable trailer door is disclosed. The apparatus includes a fluid actuated cylinder having a free end and a fixed end with the fixed end being rotatably connected to the trailer; a control member, rotatably connected to the trailer, locks the door in its closed position; a control link, having a first end rotatably connected to the control member and a second end rotatably connected to the fluid actuated cylinder free end; and, an adjustable link, having a fixed end rotatably connected to the trailer and a free end rotatably connected to both the free end of the fluid actuated cylinder and the second end of the control link.

22 Claims, 4 Drawing Sheets

40
44
42
38
46
34
32
22
16
26
18
52
50
36
48
54
58
60
24
14
30
28
12

40
44
42
38
46
34
32
22
16
18
20
52
50
36
48
54
58
60
24
14
26
30
28
12

AIR OPERATED POSITIVE LOCK FOR REFUSE TRAILER AND THE LIKE

BACKGROUND OF THE INVENTION

This invention relates to trailer doors, and more particularly to a mechanism to control the locking/unlocking of a door for closing the back end of a refuse trailer.

Refuse trailers are used in an environment that requires a highly reliable mechanism that will operate under rugged conditions. The mechanisms used to lock the rear doors of such refuse trailers may be subject to failure with the highly undesirable result that refuse can spill from the trailer. Locking mechanisms controlled by pneumatic or hydraulic cylinders can fail if the cylinders or the cylinder pressure source becomes inoperative. Additionally, adjustable links, such as turnbuckles, used in an active part of the locking mechanism can become worn and contribute to a locking failure.

SUMMARY OF THE INVENTION

It is accordingly an object of the present invention to provide a novel mechanism to lock/unlock a trailer door.

It is another object of the present invention to provide a novel mechanism to lock/unlock a trailer door that utilizes a fluid actuated cylinder combined with a novel geometric arrangement of rotatable members.

It is another object of the present invention to provide a novel mechanism to lock/unlock a trailer door that utilizes a double-acting pneumatic cylinder.

It is yet a further object of the present invention to provide a novel mechanism to lock/unlock a trailer door that provides continuous positive locking even if the fluid actuated cylinder controlling the mechanism or its pressure source fails.

It is a still further object of the present invention to provide a novel mechanism to lock/unlock a trailer door that does not utilize an adjustable member as an active part of the mechanism.

It is yet another object of the present invention to provide a novel mechanism to lock/unlock a trailer door that can be manually operated by a switch located in the truck cab or by a switch located on the trailer adjacent the door.

It is a still further object of the present invention to provide a novel mechanism to lock/unlock a trailer door that includes a safety system to prevent operation of a walking floor in the trailer when the trailer door is locked in its closed position.

The present invention utilizes a novel geometric arrangement of a fluid actuated cylinder in combination with various rotatably connected members to provide a novel mechanism to lock/unlock the trailer door. This arrangement provides positive locking even if the fluid actuated cylinder or its pressure source fails. This is achieved by geometrically arranging the rotatably connected members so they resist unlocking of the door unless such unlocking is specifically sought by actuating the fluid cylinder. This is especially important for refuse trucks which are used in an extremely rugged environment which increases the likelihood of mechanical mechanisms failing.

The invention features apparatus for locking a trailer door. It includes a trailer, a door rotatably connected to the trailer, apparatus for locking/unlocking the door in a closed position, and a control mechanism for selectively locking/unlocking the door in its closed position.

The apparatus for locking/unlocking the door further includes a fluid actuated cylinder having a free end and a fixed end with the fixed end being rotatably connected to the trailer; a control member rotatably connected to the trailer that has a locked position for locking the door in its closed position; a control link having a first end rotatably connected to the control member and a second end rotatably connected to the fluid actuated cylinder free end, so that the second end of the link is beyond top dead center when the door is locked in its closed position; and an adjustable link having a fixed end rotatably connected to the trailer, and a free end rotatably connected to both the free end of the fluid actuated cylinder and the second end of the control link.

In preferred embodiments of the invention, the door is rotatably connected to the trailer by a plurality of hinges. The door is located at the trailer back end so that it is capable of providing access to the trailer interior in its opened position and capable of sealing the trailer back end in its closed position. The fluid actuated cylinder is preferably a pneumatic cylinder and the free end of the cylinder is the end from which the cylinder piston extends. The control member is rotatably connected to the trailer at a point closer to the door than to the control link. The second end of the control link is located adjacent a rigid stop when the control member is in its locked position. The stop is positioned to impede longitudinal translation of the link away from the door. The rigid stop is, in the preferred embodiment, provided by a structural rib of the trailer. The adjustable link is substantially vertical and capable of impeding vertically upward translation of the control link when the control member is in the locked position.

The means for locking/unlocking the door in a closed position further includes a pin extending from the end of the door. The pin is substantially parallel to the plane created by the door and is capable of engaging an upwardly extending opening in the end of the control member adjacent the door. The opening in the control member engages the pin when the control member is in the locked position in response to the fluid actuated cylinder piston being substantially fully extended. The opening in the control member disengages from the pin when the control member is moved to the unlocked position in response to the fluid actuated cylinder piston being substantially fully retracted.

The apparatus for locking/unlocking the door in a closed position further includes: a plurality of pins extending from the distal end of the door that are substantially parallel and in a plane created by the door; a plurality of locking members located substantially parallel to the control member and arranged so that both the control member and the locking members are rotatably attached to the trailer along a vertical line transverse to the bottom edge of the trailer; an upwardly extending opening in the end of the control mechanism and the ends of the locking members that are capable of engaging one of the pins; and a connecting member rotatably connected to the ends of each of the locking members furthest from the door and to the control member so they operate substantially together, so that all the locking members and the control member engage one of the pins when the control member is in the locked position.

The apparatus for locking a trailer door further includes a switch for actuating a walking floor in the trailer. The switch, which is actuated by an actuation lever attached to the control member, is only capable of being actuated when the control member is in its unlocked position. Therefore, the walking floor is operable only when the control member is in the unlocked position.

All features and advantages of the invention will be apparent from the following detailed description of the preferred embodiments and from the claims.

For a full understanding of the present invention, reference should now be made to the following description and to the accompanying drawings.

DETAILED DESCRIPTION OF THE PREFERRED EMBODIMENTS

Figure 1:
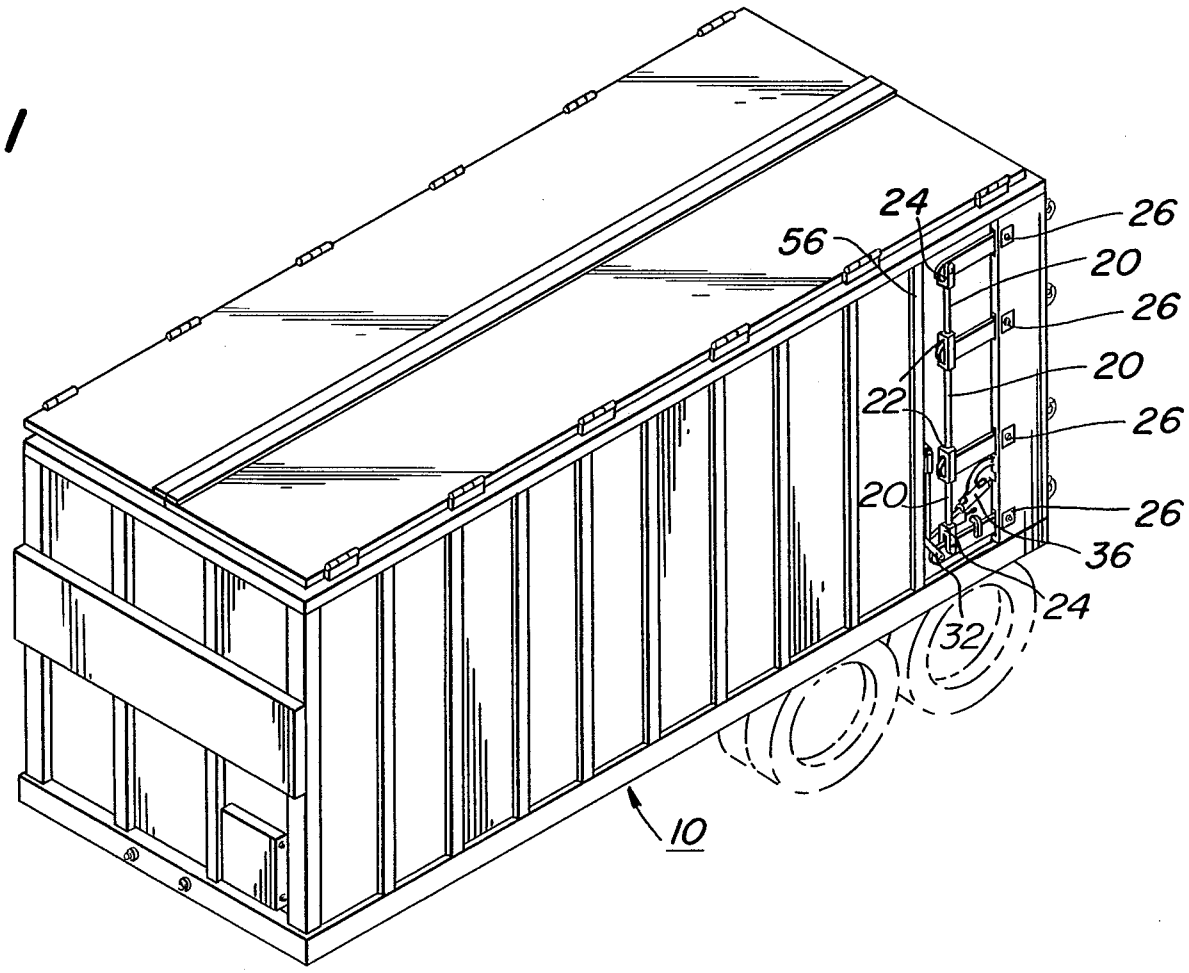
FIG. 1 is a perspective view of the invention shown on a truck trailer.
Figure 2:
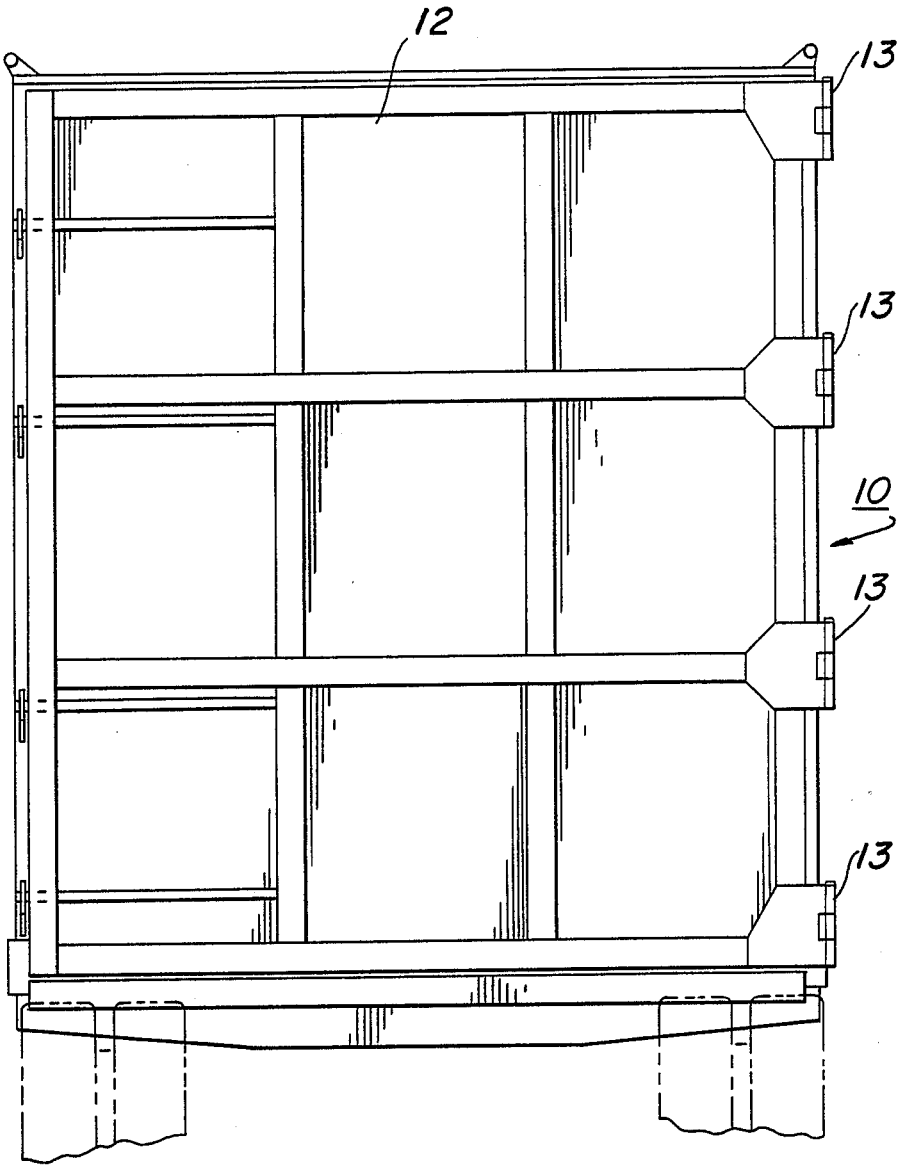
FIG. 2 is an end view of the truck trailer shown in FIG. 1.

Referring to FIG. 1, there is shown a perspective view of a preferred embodiment of the invention mounted on a refuse trailer 10. The invention comprises a rear door 12, attached to trailer 10 by hinges 13 (shown in FIG. 2), which closes the back end of refuse trailer 10, and a novel mechanism for controlling locking/unlocking of door 12.

Figure 3:
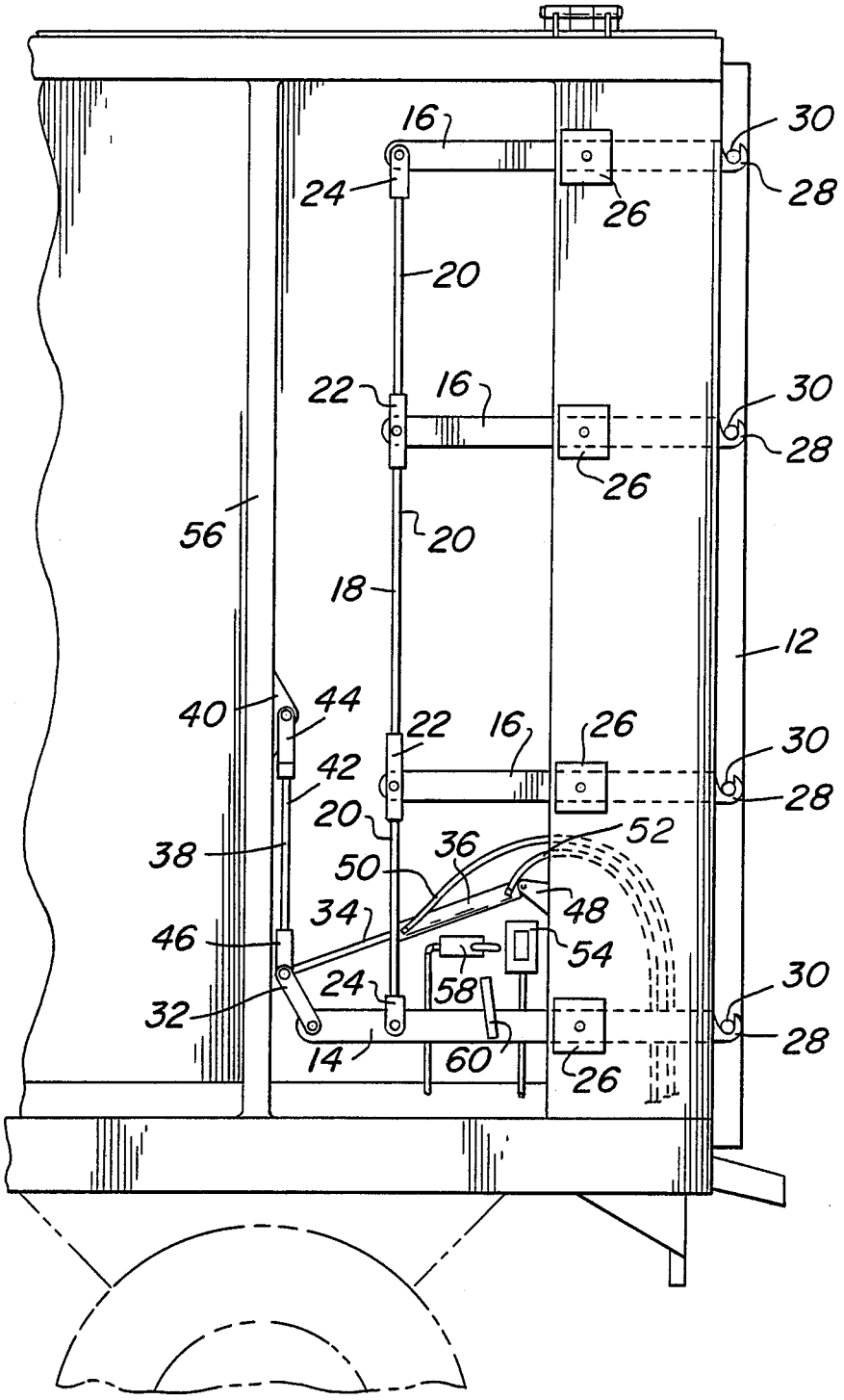
FIG. 3 is a partially cut away side view of the truck trailer shown in FIG. 1, showing the invention in more detail.

FIG. 3 shows the novel locking/unlocking mechanism in more detail. The mechanism includes a control locking member 14 and three parallel-controlled locking members 16 which are rotatably linked by connecting member 18. Connecting member 18 can typically comprise three rods 20, two box fittings 22, and two U-shaped fittings 24 as shown in FIG. 1. Control member 14 and locking members 16 are rotatably connected to the side of trailer 10 by pivots 26 which are aligned vertically along a line transverse to the bottom edge of trailer 10. The pivots are all located closer to door 12 than the connecting member 18. Additionally, control member 14 and locking members 16 all have an upwardly extending generally U-shaped opening at their ends nearest door 12. These openings are all capable of engaging pins 30 which extend from the distal end of door 12 and are transverse to the longitudinal axis of control locking member 14.

Control locking member 14 is rotatably connected, at its end furthest from door 12, to a control link 32. The opposite end of control link 32 is rotatably connected to both piston 34 of fluid actuated cylinder 36 and the bottom end of adjustable link 38. The top end of adjustable link 38 is rotatably attached to flange 40 which is rigidly affixed to trailer 10. Adjustable link 38 typically comprises a rod 42 with threaded ends and end fittings 44 and 46 for receiving threaded rod ends.

Fluid actuated cylinder 36 is rotatably connected to flange 48 which is rigidly affixed to trailer 10. One suitable fluid actuated cylinder 36 is a double-acting pneumatic cylinder such as Model 248-DPS manufactured by Bimba Manufacturing Company, Monee, Ill. 60449. Actuation fluid is provided to cylinder 36 via hoses 50 and 52 from an external pressure source (not shown). The pressure source for the actuation fluid may be provided by a tractor (not shown) adapted to pull trailer 10, or a separate pressure source (not shown) in combination with trailer 10.

Figure 4:
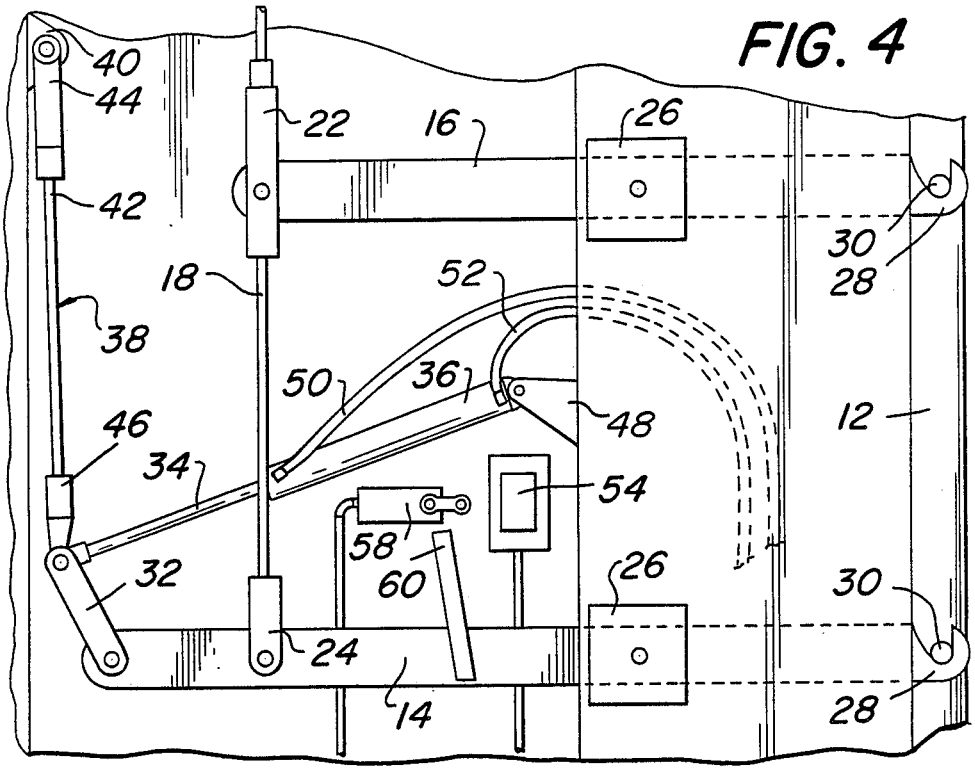
FIG. 4 is an enlarged partial view of the invention shown in FIG. 3, showing the locked position.

The operation of the invention will now be described with reference to the figures. In FIGS. 3 and 4 the novel locking/unlocking mechanism is shown in its locked position with door 12 locked and closing the back end of trailer 10. In this position, piston 34 of cylinder 36 is fully extended and pins 30 are engaged by U-shaped openings 28 of control member 14 and locking members 16.

Figure 5:
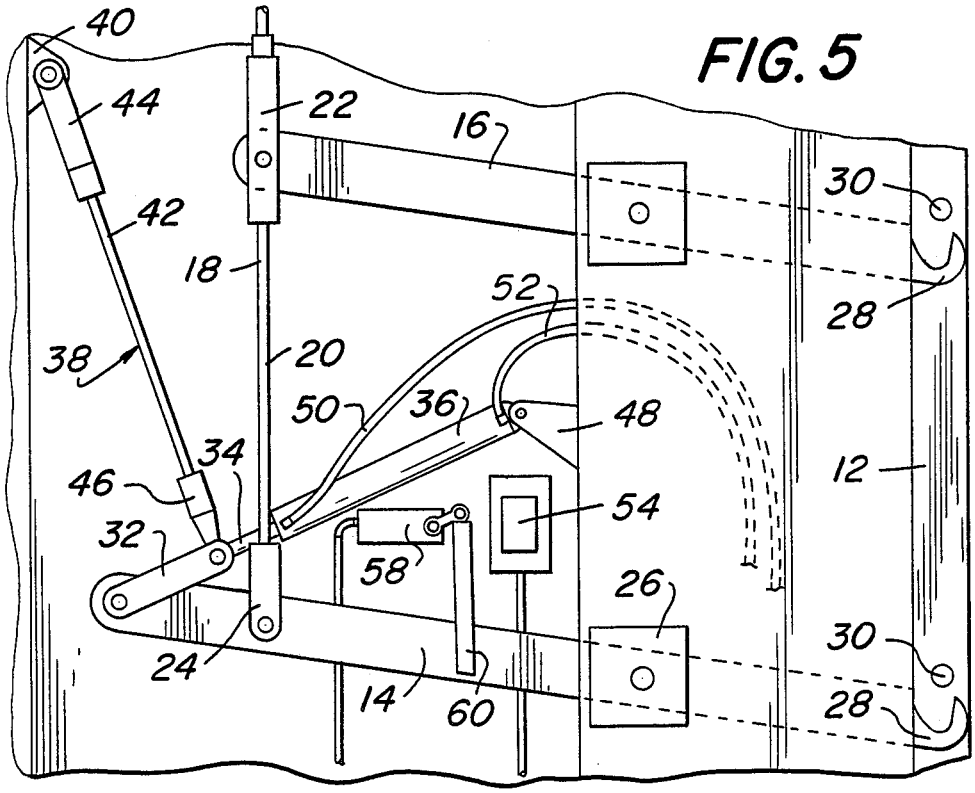
FIG. 5 is an enlarged partial view of the invention shown in FIG. 3, showing the unlocked position.

In FIG. 5, the locking/unlocking mechanism is shown in its unlocked position with door 12 free to be opened. In this position, piston 34 of cylinder 36 is fully retracted and pins 30 are not engaged by U-shaped openings 28 of control member 14 and locking members 16.

If the locking/unlocking mechanism is locked (as shown in FIGS. and 3 and 4) and the operator wishes to unlock door 12 the operator actuates manual switch 54. Upon actuation of switch 54, pressure is provided to cylinder 36 via hose 50 causing piston 34 of cylinder 36 to retract. Upon retracting, piston 34 causes both control link 32 and adjustable link 38 to rotate. Additionally, control link 32 translates towards cylinder 36 causing control locking member 14 to rotate about pivot 26. As shown in FIG. 5, when the locking/unlocking mechanism is in its unlocked position the end of member 14 nearest door 12 has rotated downward so its U-shaped opening 28 is disengaged from corresponding pin 30 extending from door 12. Additionally, the rotational movement of member 14 causes identical coordinated movement of locking members 16 due to connecting link 18 and therefore when opening 28 of control member 14 is disengaged from pin 30 the openings 28 in locking members 16 are also disengaged from pins 30.

To change the status of the locking/unlocking mechanism from its unlocked state (shown in FIG. 5) to its locked state (shown in FIG. 4) the operator again actuates manual switch 54. Upon actuation of switch 54, pressure is provided to cylinder 36 via hose 52 causing piston 34 of cylinder 36 to extend. Upon extending, piston 34 causes both control link 32 and adjustable link 38 to rotate. Additionally, control link 32 translates away from cylinder 36 causing control member 14 to rotate about pivot 26. As shown in FIGS. 3 and 4, when the locking/unlocking mechanism is in its locked position the end of control member 14 nearest door 12 has rotated upward so its U-shaped opening 28 has engaged corresponding pin 30 extending from door 12. Additionally, the rotational movement of control member 14 causes identical coordinated movement of locking members 16 due to connecting link 18, and therefore when opening 28 of control member 14 engages pin 30 the openings 28 in locking members 16 also engage pins 30.

One of the important advantages that arises from the novel geometric arrangement of the locking/unlocking mechanism is that it provides a positive door lock even if cylinder 36 or its pressure source (not shown) fails. When trailer 10 is at rest, gravity will hold control member 14 and locking members 16 in their locked positions since pivots 26 are located closer to door 12 than to connecting member 18. Additionally, when trailer 10 is moving with door 12 locked the locking/unlocking mechanism will resist moving to its unlocked state because the top end of control link 32 is rotated beyond top dead center and adjustable link 38 is substantially vertically oriented. In this position, if vibration urges the end of control locking member 14 that contains opening 28 downward, the opposite end of control member 14 will have its corresponding upward movement impeded. This upward movement of the end of control member 14 would cause the top end of control link 32 to move away from cylinder 36, but such motion is blocked by fixed rib 56 and by adjustable link 38 which cannot translate upward due to its rotatable connection to flange 40. Consequently, door 12 when locked, will tend to remain locked even if trailer 10 is both subjected to motion and cylinder 36 fails to forcibly hold its piston 34 in the fully extended position. Additionally, adjustable link 38 is not an active part of the locking/unlocking mechanism since its only purposes are to be stabilize the mechanism and to impede upward translation of control member 14 when it is in its locked position. Therefore, inevitable wear of adjustable link 38 will not detrimentally effect operation of the locking/unlocking mechanism.

An additional feature incorporated in the preferred embodiment is a safety system to prevent operation of a walking floor (not shown) when door 12 is locked in its closed position. Typically, such a refuse truck trailer would use a walking floor for removal of a load from trailer 10. Operation of such a walking floor, however, when door 12 is locked in its closed position could damage the floor being moved and door 12. Therefore, referring to FIGS. 3–5, microswitch 58, activated by actuation lever 60, is used to prevent operation of the walking floor when door 12 is locked. In FIG. 4, microswitch 58 is shown in its "off" position when door 12 is locked. When door 12 is unlocked, as shown in FIG. 5, member 14 moves actuation lever 60 upward so to make microswitch 58, thereby permitting operation of the walking floor.

In alternate embodiments of the invention, the door locking/unlocking mechanism can be operated from the truck cab in lieu of or in addition to being operable from switch 54 located on trailer 10. Cylinder 36 can be an appropriate hydraulic cylinder so the door locking/unlocking mechanism can be operated with hydraulic pressure instead of pneumatic pressure.

There has thus been shown and described a novel mechanism to control locking/unlocking of a trailer door which fulfills all of the objects and advantages sought. Any changes, modifications, variations or other uses and applications of the subject invention, will become apparent to those skilled in the art upon considering the specification and the accompanying drawings which disclose the preferred embodiments. All such changes, modifications, variations and other uses and applications within the spirit and scope of the invention are deemed to be covered by the invention which is limited only by the claims which follow.

I claim:

1. Apparatus for locking a trailer door, comprising:

(a) a trailer;

(b) a door rotatably connected to said trailer;

(c) means for locking/unlocking said door in a closed position, said means including:

(i) a fluid actuated cylinder having a free end and a fixed end, said fixed end being rotatably connected to said trailer;

(ii) a control member rotatably connected to said trailer, said control member having a first position for locking said door in its closed position, and a second position for unlocking said door from its closed position;

(iii) a control link having a first end rotatably connected to said control member, and a second end rotatably connected to said fluid actuated cylinder free end, said link having its second end beyond top dead center when said control number is in its first position;

(iv) an adjustable link, having a fixed end rotatably connected to said trailer, and a free end rotatably connected to both said fluid actuated cylinder free end and said second end of said control link; and (d) a control mechanism for selectively moving said control member between its first and second positions.

2. The apparatus of claim 1, wherein said door is rotatably connected to said trailer by a plurality of hinges.

3. The apparatus of claim 1, wherein said door is located at said trailer back end, said door capable of providing access to said trailer interior in its opened position and capable of sealing said trailer back end in its closed position.

4. The apparatus of claim 1, wherein said fluid actuated cylinder is a pneumatic cylinder and said free end of said cylinder is the end from which a piston of said cylinder extends.

5. The apparatus of claim 1, wherein said control member is rotatably connected to said trailer at a point closer to said door than to said control link.

6. The apparatus of claim 1, wherein said control link second end is located adjacent a rigid stop when said control member is in its locked position, said stop being positioned to impede longitudinal translation of said link away from said door.

7. The apparatus of claim 6, wherein said rigid stop is provided by a structural rib of said trailer.

8. The apparatus of claim 1, wherein said adjustable link is substantially vertical and capable of impeding vertically upward translation of said control link when said control member is in said locked position.

9. The apparatus of claim 1, wherein said means for locking/unlocking said door in a closed position, further comprises a pin extending from the distal end of said door, said pin being substantially parallel to the plane created by said door and capable of engaging an upwardly extending opening in said control member end adjacent said door.

10. The apparatus of claim 9, wherein said opening in said control member engages said pin when said control member is in said locked position responsive to said fluid actuated cylinder piston being substantially fully extended, and said opening in said control member disengages from said pin when said control member is moved to said unlocked position responsive to said fluid actuated cylinder piston being substantially fully retracted.

11. The apparatus of claim 1, wherein said means for locking/unlocking said door in a closed position, further comprises:

(a) a plurality of pins extending from the distal end of said door, said pins being substantially parallel to the plane created by said door;

(b) a plurality of locking members located substantially parallel to said control member, said control member and said locking members each being rotatably attached to said trailer along a vertical line transverse to the bottom edge of said trailer, said control member and said locking members each having an upwardly extending opening in said ends adjacent said door capable of engaging one of said pins; and (c) a connecting member rotatably connected to the ends of each of the locking members furthest from said door and to the control member so they operate substantially together, whereby all the locking members and the control member engage one of said pins when said control member is in said locked position.

12. The apparatus of claim of 1, further comprising a switch for actuating a walking floor in said truck, said switch being actuated by an actuation lever, attached to said control member, capable of actuating said switch only when said control member is in its unlocked position, whereby said walking floor is operable only when said control member is in said unlocked position.

13. Apparatus for securing a trailer door, comprising:

(a) a trailer;

(b) a door pivotally connected to said trailer;

(c) means for releasably securing said door in a closed position, said means including (i) a fluid actuated cylinder rotatably fixed to said door at a first end and having a free second end, (ii) a control member pivotally connected to said trailer, said control member fixing said door in a closed position in a first position and releasing said door from its closed position in a second position (iii) a control link pivotally connected to a first end of said control member at a first end and pivotally connected to said fluid actuated cylinder at a second end, said control link having its second end oriented counter clockwise from a vertical line drawn through the pivotal connection of the first end when said control member is in its first position;

(iv) an adjustable link, pivotally connected to said trailer at a first end and pivotally connected to said pivotal connector of said fluid actuated cylinder and said control link at a second end, said adjustable link oriented substantially vertically when said control member is in its first position; and (d) control means for selectively moving said control member between its first and second position

14. The apparatus of claim 13, wherein said door is pivotally connected to said trailer by at least one hinge.

15. The apparatus of claim 13, wherein said fluid actuated cylinder is a pneumatic cylinder and said free second end of said cylinder is the end from which a piston of said cylinder extends.

16. The apparatus of claim 13, wherein the pivotal connection between said control member and said trailer is closer to said door than said control link.

17. The apparatus of claim 13, further including a rigid stop oriented adjacent said control link to impede translation of said control link away from said door further than said substantially vertical orientation.

18. The apparatus of claim 17, wherein said rigid stop is provided by a structural rib of said trailer.

19. The apparatus of claim 13, wherein said control member when in said substantially vertical orientation impedes vertically upward translation of said control link.

20. The apparatus of claim 13, wherein said means for releasably securing said door further comprises at least one pin extending from a distal end of said door, said pin being substantially parallel to a plane created by said door and capable of engaging an upwardly extending opening in a second end of said control member.

21. The apparatus of claim 20, wherein said opening in said second end of said control member engages said pin when said control member is in said secured position responsive to said fluid actuated cylinder in a substantially fully extended position, and said opening in said control member disengages said pin when said control member is in a release position responsive to said fluid actuated cylinder in a substantially fully retracted position.

22. The apparatus of claim 13, wherein said means for securing said trailer door further comprises:

(a) a plurality of pins extending from the distal end of said door substantially parallel to a plane created by said door.

(b) a plurality of locking members oriented substantially parallel to said control member, said control member and said locking members each being pivotally mounted to said trailer at points along a line parallel to a plane created by said door in a closed position, said control member and each of said locking members having an upwardly extending opening in second ends capable of engaging one of said pins; and (c) a connecting member pivotally connected to first ends of said locking members and pivotally connected adjacent the first end of said control member so they operate together in a substantially parallel orientation, whereby all said locking members and said control member engage one of said pins when said control member is in said fixing position.

* * * * *

UNITED STATES PATENT AND TRADEMARK OFFICE

CERTIFICATE OF CORRECTION

PATENT NO. : 4,762,345

DATED : August 9, 1988

INVENTOR(S) : Eugene F. Stluka et al

It is certified that error appears in the above-identified patent and that said Letters Patent is hereby corrected as shown below:

Column 4, line 23, delete the word "and" first occurrence.

Column 7, line 52, replace "position" with --positions.--

Signed and Sealed this

Sixth Day of December, 1988

*Attest:*

DONALD J. QUIGG

*Attesting Officer*

*Commissioner of Patents and Trademarks*